United States Patent [19]

Kapitza et al.

[11] 4,262,176

[45] Apr. 14, 1981

[54] ROLLER SHUTTER SAFETY DEVICE

[75] Inventors: Wolfgang B. Kapitza, Hillsdale, Australia; William H. Steele, deceased, late of Bonnet Bay, Australia; by Marie-Therese Annis-Brown, legal representative, Millmerran, Australia

[73] Assignee: Byrne & Davidson Doors Pty. Limited, Australia

[21] Appl. No.: 17,817

[22] Filed: May 30, 1979

[30] Foreign Application Priority Data

Mar. 17, 1978 [AU] Australia ..... PD 3748/78

[51] Int. Cl.[3] ..... H01H 3/16

[52] U.S. Cl. ..... 200/61.43; 200/61.7; 49/27

[58] Field of Search ..... 200/153 T, 61.43, 61.7, 200/61.62; 49/27

[56] References Cited

U.S. PATENT DOCUMENTS 3,754,176 8/1973 Miller ..... 200/61.43 X 3,931,911 1/1976 Kohl ..... 200/153 T X 4,115,952 9/1978 French ..... 200/61.43 X

FOREIGN PATENT DOCUMENTS 1127673 9/1968 United Kingdom ..... 200/153 T

*Primary Examiner*—J. V. Truhe

*Assistant Examiner*—Richard M. Moose

*Attorney, Agent, or Firm*—Stevens, Davis, Miller & Mosher

[57] ABSTRACT

This invention relates to a switching arrangement for use in stopping or reversing an electrically driven roller door when an object lying in its path is struck during closing. The arrangement comprises a switch bar extending the width of the door curtain and projecting below its bottom edge, hinge mounting means securing the bar to the curtain and permitting swing movement about a horizontal axis, resilient loading means urging the bar into a rest position in which the lowermost bar surface is laterally displaced from the axis and a switch actuated by movement of the bar from its rest position.

4 Claims, 3 Drawing Figures

ROLLER SHUTTER SAFETY DEVICE

BACKGROUND OF THE INVENTION

This invention relates to roller doors of the kind comprising a semi-rigid curtain able to be wrapped upon a drum structure extending above a doorway and to be unwrapped from that drum structure to constitute a closure for the doorway. More particularly, the invention relates to electrically driven roller doors of the above-mentioned kind.

In the past, if the curtain of an electrically driven roller door should strike an object lying in its path as the door is closing, substantial damage is likely to occur to the door assembly and drive means as well as to the object struck. The latter is especially significant when the object struck is a person.

An object of the present invention is to overcome the above indicated disadvantage by providing in an electrically driven roller door switching means on the bottom edge of the door curtain which extend substantially the width of the curtain, in combination with a drive motor control device to reverse the downward travel of the curtain when an object is struck.

SUMMARY OF THE INVENTION

The present invention consists in a switching arrangement comprising a switch bar extending substantially the width of the curtain of a roller door and projecting below the bottom edge of said curtain, hinge mounting means securing said bar to said curtain for swing movement about a horizontal axis, resilient loading means urging said bar into a rest position, wherein the lowermost line of the surface of said bar is laterally displaced from the hinge axis, and a switch actuated by movement of said bar from said rest position.

BRIEF DESCRIPTION OF THE DRAWINGS

By way of example only, an embodiment of the present invention is described with reference to the accompanying drawings in which.

DESCRIPTION OF THE PREFERRED EMBODIMENT

Figure 2:
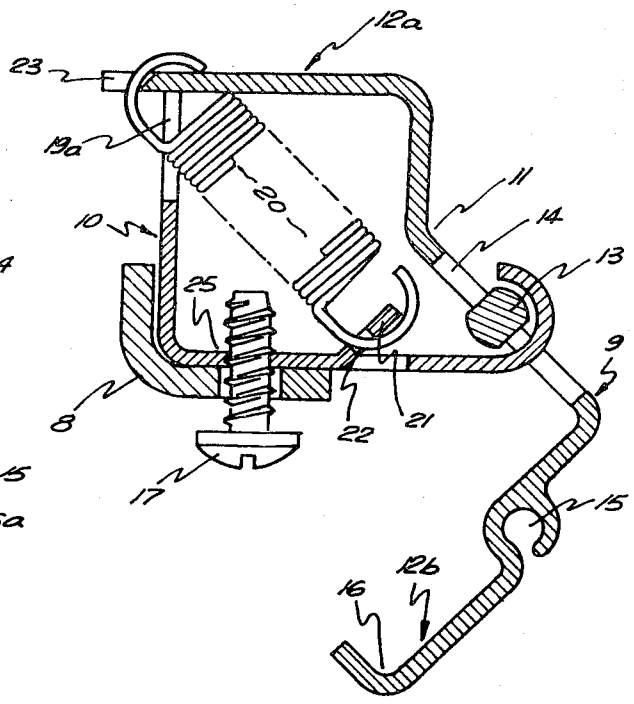
FIG. 2 is a second sectional view of a switching arrangement according to the invention.
Figure 1:
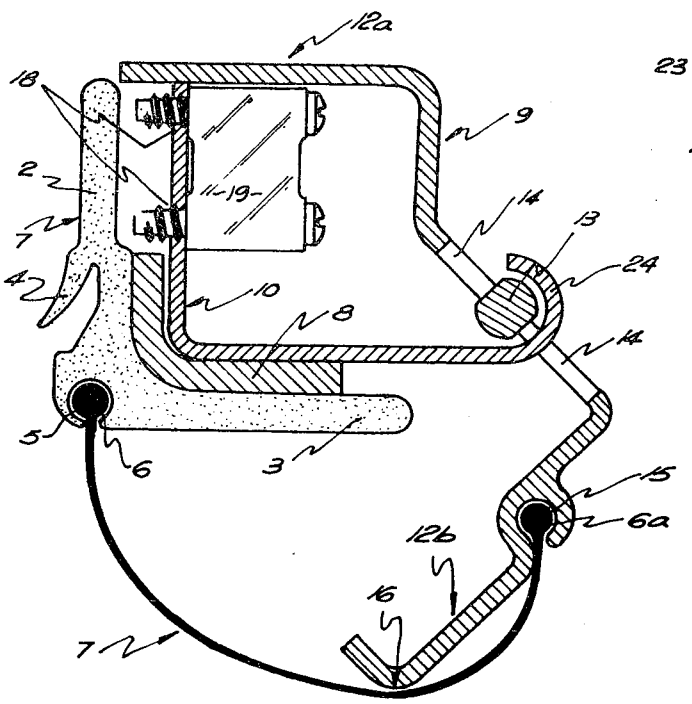
FIG. 1 is a sectional view of a switching arrangement according to the invention.

With reference to FIGS. 1 and 2, the switching arrangement includes an angle-sectioned bottom rail that extends substantially the width of a roller door curtain at the bottom edge thereof with one flange 2 projecting vertically and the other flange 3 horizontally. The vertical flange 2 of the bottom rail is provided with a elongate raised rib 4 that is adapted to fixedly retain the bottom rail 1 to the door curtain (not shown). This is effected by positioning a backwardly folded curtain edge between the vertical flange 2 and the rib 4 which is then deformed to clamp the edge margin of the curtain between the rib and flange. The horizontal flange 3 of the bottom rail is provided with an elongate receptor groove 5 that runs the length of the rail for receipt of one edge bead 6 of a pliable weatherproofing strip 7 that will be described in more detail hereinafter.

If desired a weight bar 8 may be nested within the aforesaid rail secured to the curtain to increase the weight applied to the curtain.

A switch bar 9 is mounted for hinging action relative to the bottom rail by a plurality of switch bar brackets 10 (described hereinafter) spaced along the bottom rail. The switch bar 9 comprises a generally channel-shaped extrusion comprising a bar web 11 and two bar flanges **12*a* and 12*b*. The bar web 11 includes an integral elongate bead 13 which spans holes 14 formed in bar 9 after extrusion, so that the bead 13 then constitutes axles for engagement with the aforesaid brackets 10**.

The bar flanges **12*a* and 12*b* diverge somewhat so that, in use one, the upper flange 12*a* a may be substantially horizontal while the lower flange 12*b*** is inclined downwardly.

The said upper flange **12*a* of switch bar 9** is substantially flat.

The lower flange of the switch bar includes a second elongate receptor groove 15 extending substantially the length of the switch bar for receipt of another bead **6*a* on the edge of the weatherproof strip 7 opposite to that of the first mentioned bead 6**.

The weatherproof strip 7 extends substantially the width of the curtain and comprises a pliable strap-like body portion with said beads 6 and **6*a* extending respectively along the longitudinal edges. The beads are adapted for respective securement in the aforesaid receptor grooves 5 and 15** with the strip body portion then extending there between in a curved conformation to exclude the ingress of water and dust or the like into the switch bar assembly when the door is in the closed position with the switch bar assembly in close proximity to the ground.

The inclined lower flange of the switch bar terminates in a striker portion 16 which contacts the inner surface of the weatherproofing strip to effect swing operation of the bar upon deformation of the body portion of the strip occasioned by contact with an obstruction.

A plurality of switch bar brackets 10 are attached to the bottom rail 1 through weight bar 8 when in use at intervals along its length by screws 17. Each bracket is substantially "L" shaped having upright and horizontal flanges. The upright flange of one of the brackets 10 contains two screw clearance holes 18 for the attachment of a micro-switch 19. A portion **19*a* of the upright flange of at least one bracket is cut away to provide a clearance for a resilient loading spring 20**.

An upwardly turned tongue 21 provided with a clearance hole 22 near its edge is also formed from the body of the horizontal flange of said at least one bracket to receive one end of the loading spring 20, the other end of which hooks over the edge of the upper flange of the switch bar through slot 23 formed in the flange **12*a***.

The horizontal flange of each bracket is provided with a part cylindrical hinging formation 24 formed by an upturned edge margin of the flange.

A screw clearance hole 25 for attachment of each bracket to the bottom rail pierces each bracket's horizontal flange.

The switch bar is retained in its rest position, wherein its upper flange is in engagement with the top edges of the upright flanges of the brackets, by the loading spring 20.

When the resilient weatherproof cover 7 strikes an object, it deforms and bears against the switch bar lower flange **12*b* to cause the bar to swing about the hinge line so as to lift the bar's upper flange 12***a* from its rest position against the effect of the loading spring 20.

The micro-switch 19 is normally held in one position by the switch bar, upper flange 12*a*, but moves to its other position when that flange lifts as aforesaid and may be used to control drive motor reversing means effective to reverse the direction of travel of the door. It will be appreciated that the motor control means may take any appropriate form and are not an essential feature of the invention. Nevertheless, as an example a preferred arrangement for the drive of the door is described hereinafter.

Figure 3:
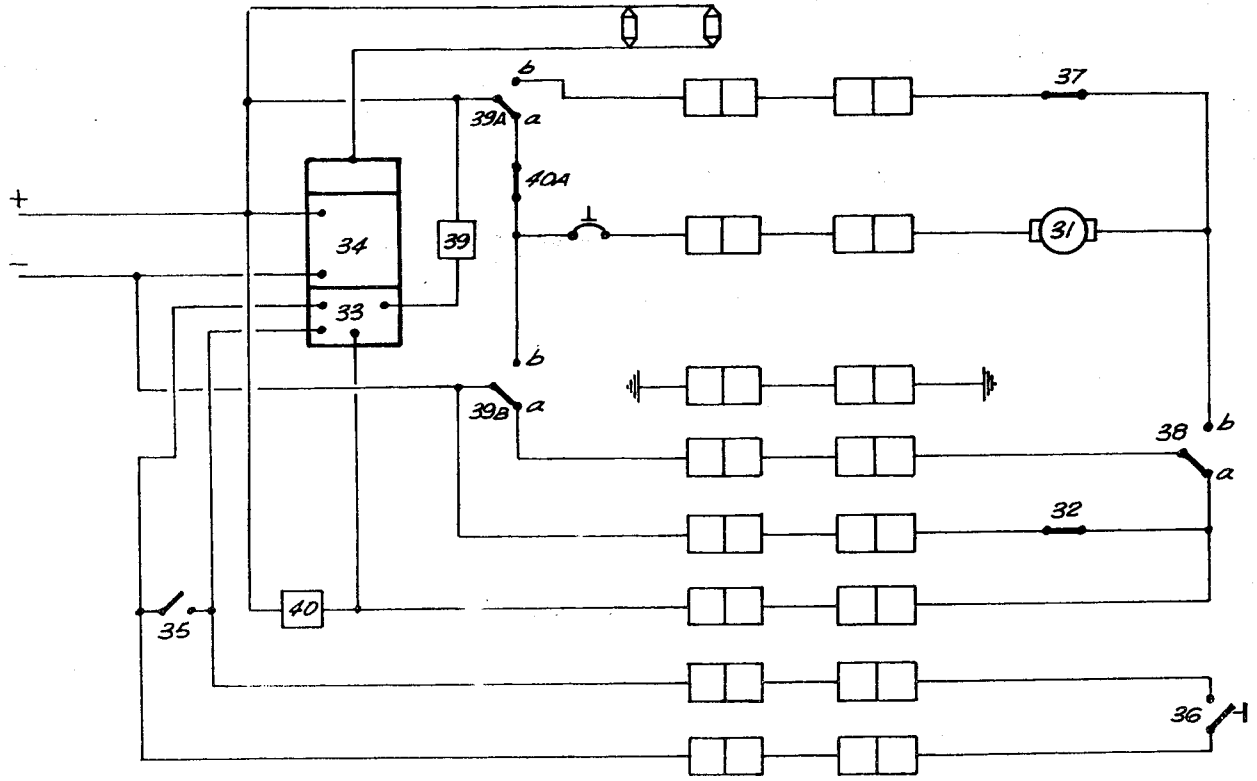
FIG. 3 is a schematic diagram of an electronic control device that may be used in conjunction with the switching means of FIGS. 1 and 2.

With reference to FIG. 3 there is shown a schematic circuit for control of a motor 31 driving a curtain door and incorporating apparatus according to the invention shown schematically at 32.

A flip-flop circuit 33 is adapted to be switched by radio receiver 34 on receipt of a radio signal or to be switched manually by a switch 35 or a remote switch 36.

The circuit is shown in an initial state in which the curtain is in its closed position.

A normally closed upper limited switch 37 is adapted to open when the curtain reaches a predetermined opening. A lower limit switch 38 is adapted to close with contact a thereof when the curtain reaches a predetermined position of closure and otherwise to close with contact b thereof.

A relay 39 is actuated by flip-flop 33 when the latter is switched to its "up" mode. Relay 39 controls contacts 39A and 39B which close with contacts a when in the "down" mode and contacts b when relay 39 is energized in the "up" mode.

Relay 40 is energized by closure of switch 32 which is normally closed but which is opened by operation of the switch bar as previously described.

When energized relay 40 holds contacts 40A closed.

The operation of the circuit is as follows: switching flip-flop 33 into its "up" mode energizes relay 39 and contacts 39A close at b driving motor 31 in its "up" direction. As soon as the curtain is raised clear of the ground lower limit switch 38 is released and makes with contact b. Motor 31 continues to operate in its "up" direction until upper limit switch 37 is actuated and opens whereupon motor 31 is de-energized, or until flip-flop 33 is switched into a "down" mode whereupon relay 39 is de-energized, contacts 39A and B close at a, and the polarity of the motor is thus reversed driving the curtain down. While in the "up" mode actuation of switch 32 has no effect.

When the motor is driving the curtain down the motor may be de-energized in any of the following ways.

1. Flip-flop 33 may be switched to its "up" mode thereby energizing relay 39 and reversing the motor polarity as described above.

2. The curtain may actuate lower limit switch 38 thereby de-energizing the motor.

3. Switch 32 may be actuated by an object obstructing the path of the curtain causing the switch bar to swing and operating the microswitch as previously described, whereupon switch 32 opens.

Relay 40 is thereby de-energized, releasing contacts 40A and de-energizing the motor.

At the same time the flip-flop 33 is driven into its "up" mode by interruption of the negative supply at terminal c.

As will be understood by those skilled in the art the switching arrangement described can be employed in a variety of other circuits.

I claim:

1. A switching arrangement for mounting to the curtain of a roller door comprising a switch bar extending substantially the width of the door curtain to which it is mounted;

hinge mounting means for securing said bar to the curtain whereby the switch bar is located so as to project below the bottom edge of the curtain, said hinge mounting means permitting swing movement of said switch bar about a horizontal axis when so mounted, resilient loading means urging said bar into a rest position wherein the lowermost line of said bar is horizontally displaced from the hinge axis, a switch acutated by movement of said bar from said rest position, and enclosure means comprising a pliable strip extending substantially the length of said switch bar, one side edge of which is attached to said bar, the other side edge of which is mounted to said hinge mounting means, said strip passing below said lowermost line of said bar.

2. An arrangement according to claim 1, wherein said hinge mounting means includes an elongate raised rib adapted to retain said arrangement to a roller door curtain.

3. An arrangement according to claim 1, wherein said switch bar comprises a channel shape extrusion having a web, two bar flanges and an elongated bead spanning apertures through and defined by said web.

4. An arrangement according to claim 3, wherein said hinge mounting means comprise brackets mounted to said curtain engaging with said bead, whereby said bead constitutes an axle about which said switch bar may be tilted.

* * * * *